US005301755A

United States Patent [19]

George et al.

[11] Patent Number: 5,301,755

[45] Date of Patent: Apr. 12, 1994

[54] AIR CHAMBER ACTUATOR FOR A PERFORATING GUN

[75] Inventors: Flint R. George, Flower Mound; Kevin R. George, Columbus, both of Tex.

[73] Assignee: Halliburton Company, Houston, Tex.

[21] Appl. No.: 31,161

[22] Filed: Mar. 11, 1993

[51] Int. Cl.[5] ..... E21B 29/00; E21B 43/11

[52] U.S. Cl. ..... 166/297; 166/299; 175/4.56

[58] Field of Search ..... 166/55.1, 297, 299; 175/4.52, 4.54, 4.56

[56] References Cited

U.S. PATENT DOCUMENTS

| | | | |
|---|---|---|---|
| 4,509,604 | 4/1985 | Upchurch | 175/4.56 |
| 4,560,000 | 12/1985 | Upchurch | 166/55.1 |
| 4,616,718 | 10/1986 | Gambertoglio | 166/55.1 |
| 4,760,884 | 8/1988 | Haugen et al. | 166/377 |
| 4,924,952 | 5/1990 | Schneider | 175/4.54 |
| 4,969,525 | 11/1990 | George et al. | 175/4.54 |
| 5,161,616 | 11/1992 | Colla | 175/4.56 |
| 5,167,282 | 12/1992 | Schneider et al. | 175/4.56 |

OTHER PUBLICATIONS

Engineered Well Completion Product Catalog of Vann Systems, pp. TCP-1018, 1020, 1022, and 1028 (Undated but admitted to be prior art).

Otis Products and Services Catalog OEC 5516 (1989), p. 94.

U.S. Patent Application Ser. No. 07/868,832 of Schultz et al., entitled SHUT-IN TOOLS, filed Apr. 14, 1992.

*Primary Examiner*—Ramon S. Britts
*Assistant Examiner*—Frank S. Tsay
*Attorney, Agent, or Firm*—Tracy W. Druce; Lucian Wayne Beavers

[57] ABSTRACT

A firing head actuator for a perforating gun includes an atmospheric pressure chamber which is run into the well on a slick line. The atmospheric pressure chamber can then be communicated with a low pressure side of an actuating piston to move the piston and initiate firing of the perforating guns. Either pyrotechnic or electrical time delays may be built in to the firing head actuator.

28 Claims, 7 Drawing Sheets

AIR CHAMBER ACTUATOR FOR A PERFORATING GUN

BACKGROUND OF THE INVENTION

1. Field Of The Invention

The present invention relates generally to methods and apparatus for perforating wells.

2. Description Of The Prior Art

One operation commonly performed in the completion of an oil or gas well is the perforation of the steel casing of the well to communicate the well bore with a subsurface formation intersected by the well. Thus, formation fluids are allowed to be produced from the formation through the perforations and up through the well bore.

Many techniques have been used in the past to actuate perforating guns to accomplish the formation of the perforations. For example, perforating guns have been actuated: (1) electrically; (2) through drop bar mechanisms; and (3) through pressure actuated mechanisms.

One commonly used technique for conveying the perforating guns and associated apparatus into the well is to assemble the same on a tubing string thus providing what is commonly referred to as a tubing conveyed perforating system. Such tubing conveyed perforating systems are available from the Halliburton Reservoir Services division of Halliburton Company, the assignee of the present invention.

One commonly used operating system for tubing conveyed perforating systems is a firing head which operates in response to a pressure differential. The pressure differential is created by applying increased pressure either to the tubing string or to the annulus surrounding the tubing string and conveying that increased pressure to an actuating piston contained in the firing head. Typically, such a firing head will have hydrostatic pressure balanced across the actuating piston as the tool is run into the well. When it is desired to operate the tool, increased pressure is applied to one side of the actuating piston. Thus, the low pressure reference for the actuating piston is hydrostatic pressure, and a pressure differential is created by increasing pressure on the high pressure side of the piston above hydrostatic pressure. One example of such a system is the Vann Systems differential firing head shown at page TCP-1020 of Vann Systems Engineered Well Completion Product Catalog.

Another approach of the prior art has utilized an isolated atmospheric chamber contained within a firing head as a low pressure reference zone. For example Vann Systems Pressure Actuated Firing Head shown at page TCP-1022 of Vann Systems Engineered Well Completion Product Catalog illustrates a firing head operating in response to increased tubing pressure which creates a pressure differential as compared to an atmospheric pressure chamber which is in constant communication with the low pressure side of the actuating piston.

The prior art also includes dual firing heads such as Vann Model APF-C as shown at page TCP-1028 of Vann Systems Engineered Well Completion product catalog.

There are sometimes disadvantages to using firing heads which require substantial pressure to be applied to the tubing or well casing to provide the increase in pressure which actuates the tool. In some instances, the pressures necessary to actuate the tools may be excessively high. Also, in many well perforation jobs it is desirable to perforate in an underbalanced condition, that is with a relatively low pressure present in the well when perforating occurs, and thus if high pressures are applied to actuate the perforating gun, it is necessary to be able to bleed off those high pressures very rapidly before the well is actually perforated.

On the other hand, in many situations it is undesirable to use drop bar actuated firing heads or electrically actuated firing heads.

Thus it is seen that there is a need for a pressure actuated firing system which can avoid or eliminate the application of excessively high pressures.

SUMMARY OF THE INVENTION

The present invention provides improved methods and apparatus for perforating oil and gas wells with a firing head which operates in response to a pressure differential. This result is achieved in a novel fashion through the use of an atmospheric pressure chamber which is lowered into a well on a wireline and brought into operative engagement with a firing head contained in a tubing conveyed perforating string.

The firing head of the tubing conveyed perforating string includes a differential pressure actuating piston which initially has hydrostatic pressure balanced thereacross. The atmospheric pressure chamber is brought into communication with a low pressure side of the actuating piston thus creating a pressure differential wherein the high pressure is hydrostatic pressure and the low pressure is substantially atmospheric pressure.

Thus a differential pressure actuation is provided without the need for applying excessive operating pressures to the tubing string. In one embodiment, no pressure is required to be applied to the tubing string.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
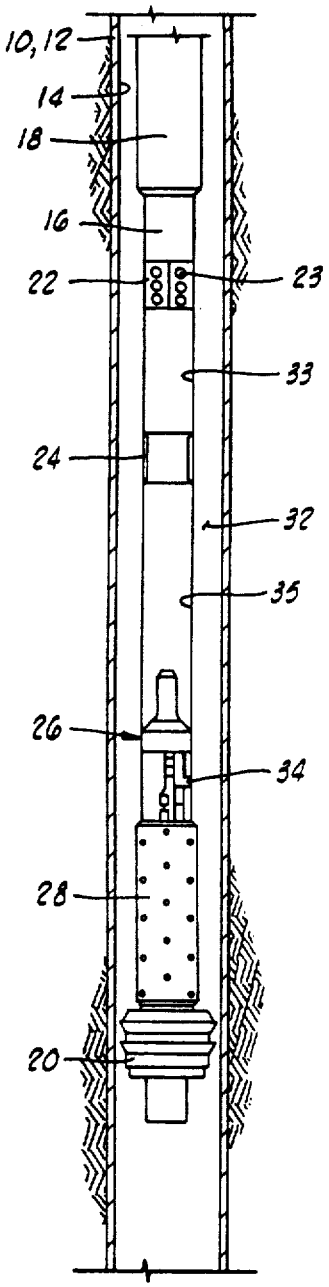
FIGS. 1-3 comprise a sequential series of schematic illustrations of a tubing conveyed perforating system utilizing a firing head actuator having an atmospheric pressure chamber with a timer controlling operation of the pressure chamber.
Figure 2:
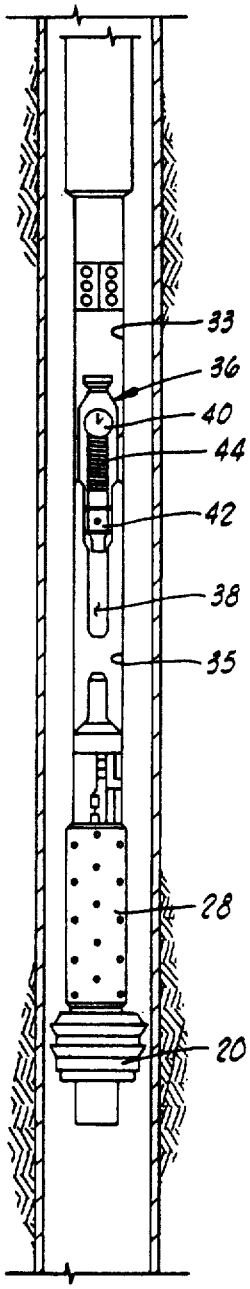
Figure 3:
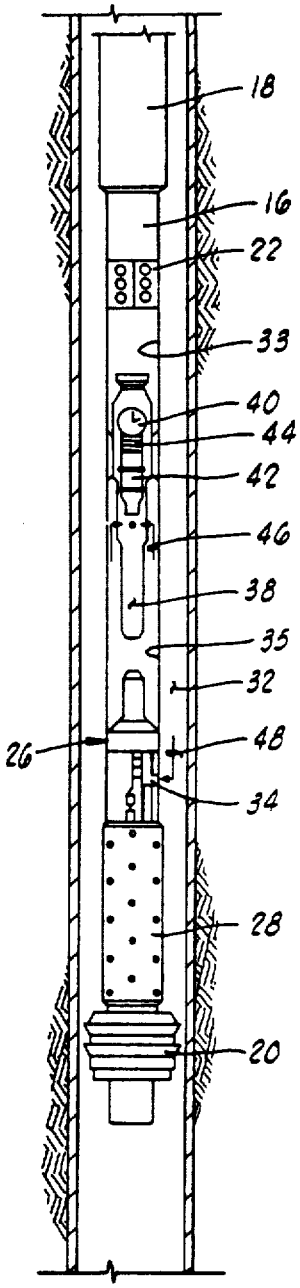

Referring now to the drawings, and particularly to FIGS. 1-3, a well 10 is represented schematically by a well casing 12 having a well bore or casing bore 14 defined therein. A portion of a tubing string 16 is shown in place within the well bore 14. It will be appreciated that the tubing string 16 is lowered into the well bore 14 from the earth's surface and the tubing string 16 will initially extend entirely to the surface of the well.

In FIG. 1, only a lower portion of the tubing string 16 is illustrated and an on/off tool 18 has been disconnected from an upper tubing string portion so as to leave the lower portion 16 of the tubing string in place within the well bore. An auto release gun hanger 20 on the lower end of the tubing string 16 anchors the tubing string 16 in place within the well bore 14.

The tubing string 16 has assembled therewith a perforated nipple 22, a seating nipple or landing nipple 24, a differential firing head 26, and a perforating gun 28.

Although not illustrated in FIG. 1, the upper portion of the tubing string 16 above the on/off tool 18 may carry a conventional packer if desired and the auto release gun hanger may be eliminated if the tubing string 16 is suspended in the well from the drawworks located at the earth's surface or from a packer assembled with the tubing string.

The present invention is not directed to these details of the manner in which the tubing conveyed perforating string is retained in the well, but instead deals only with the preferred mechanisms and methods for actuating the tubing conveyed perforating string. Thus the other details commonly associated with a tubing conveyed perforating string will not be illustrated or described in detail and will be understood to be conventional in manner.

Figure 4A:
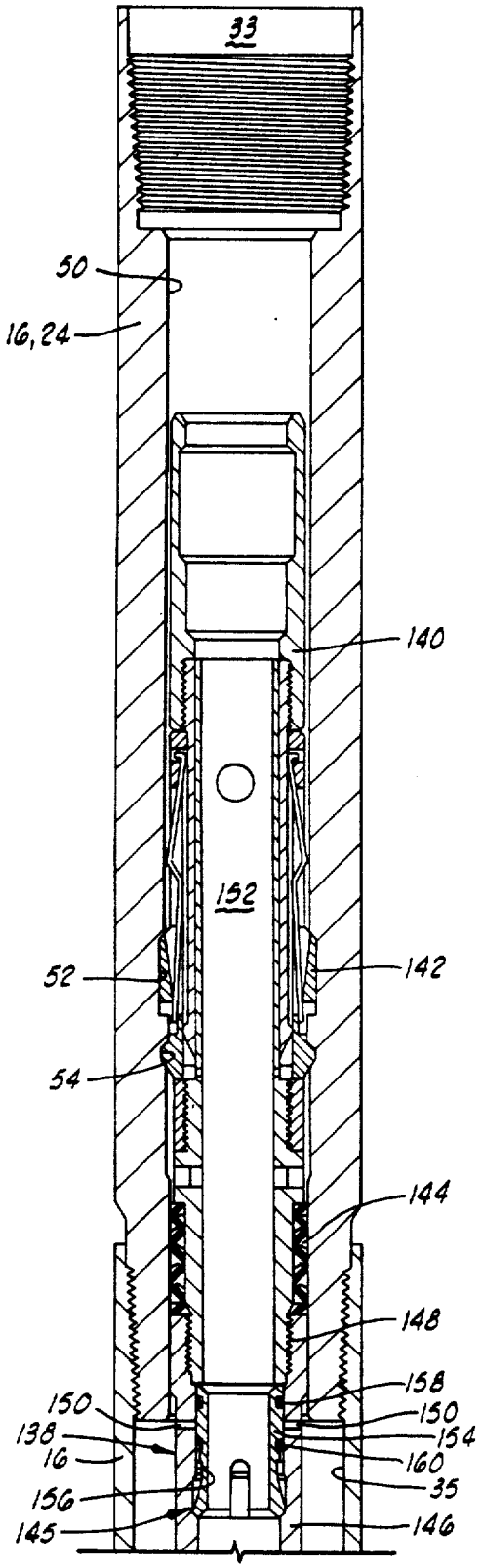
FIGS. 4A-4H comprise an elevation sectioned view of a first embodiment of the invention utilizing a pressure actuated pyrotechnic timer associated with the atmospheric pressure chamber.
Figure 4B:
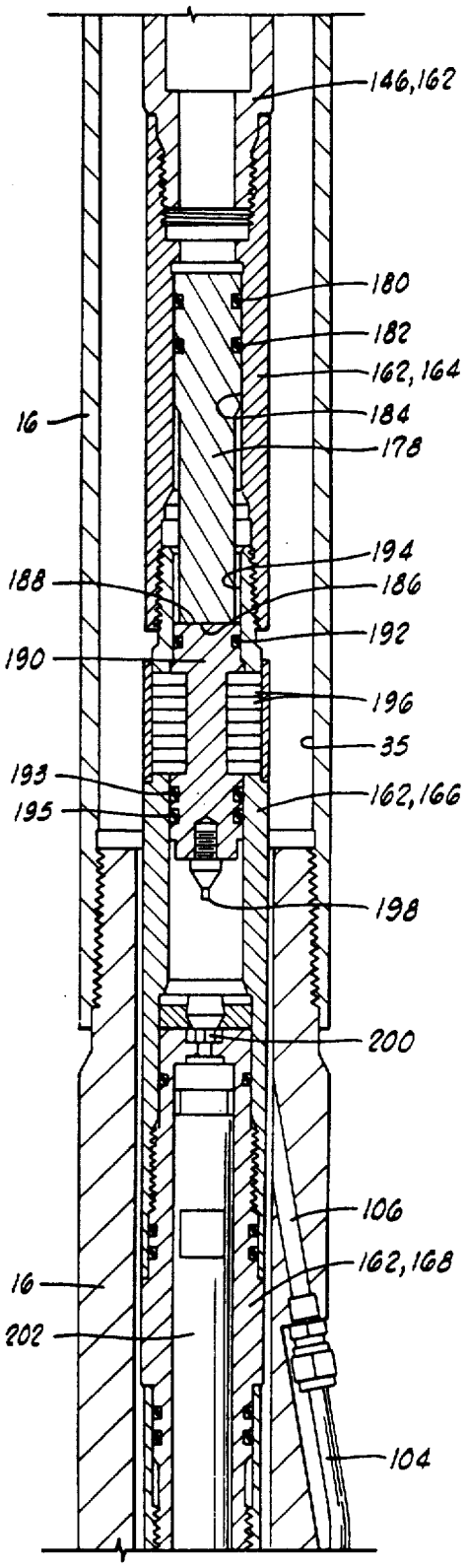
Figure 4C:
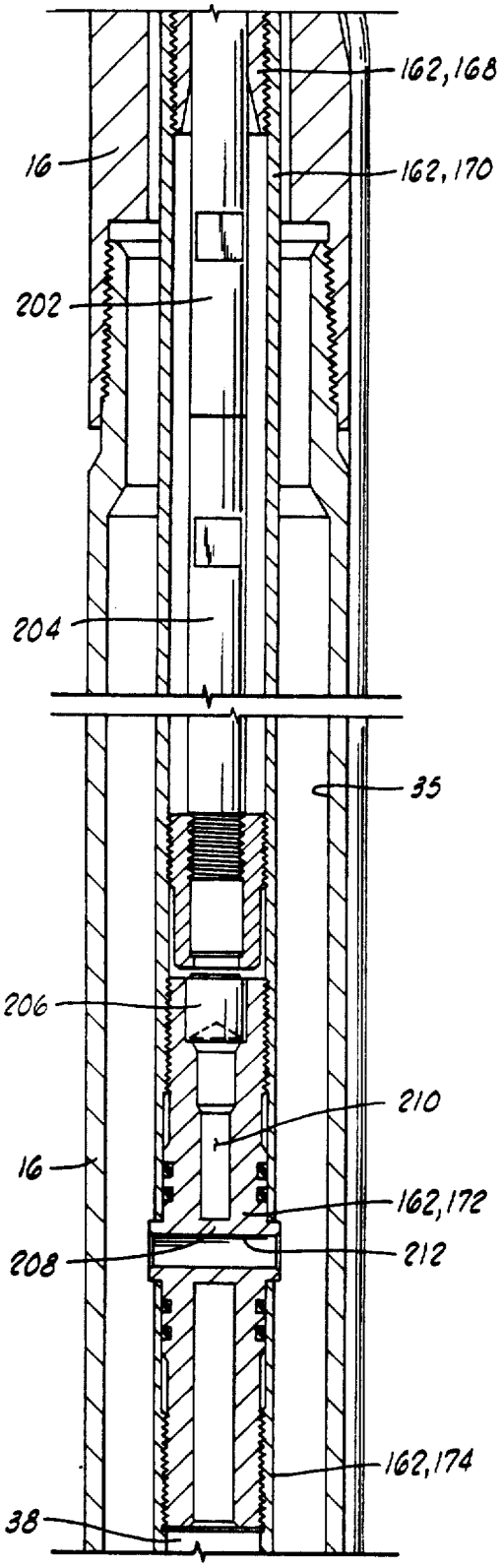
Figure 4D:
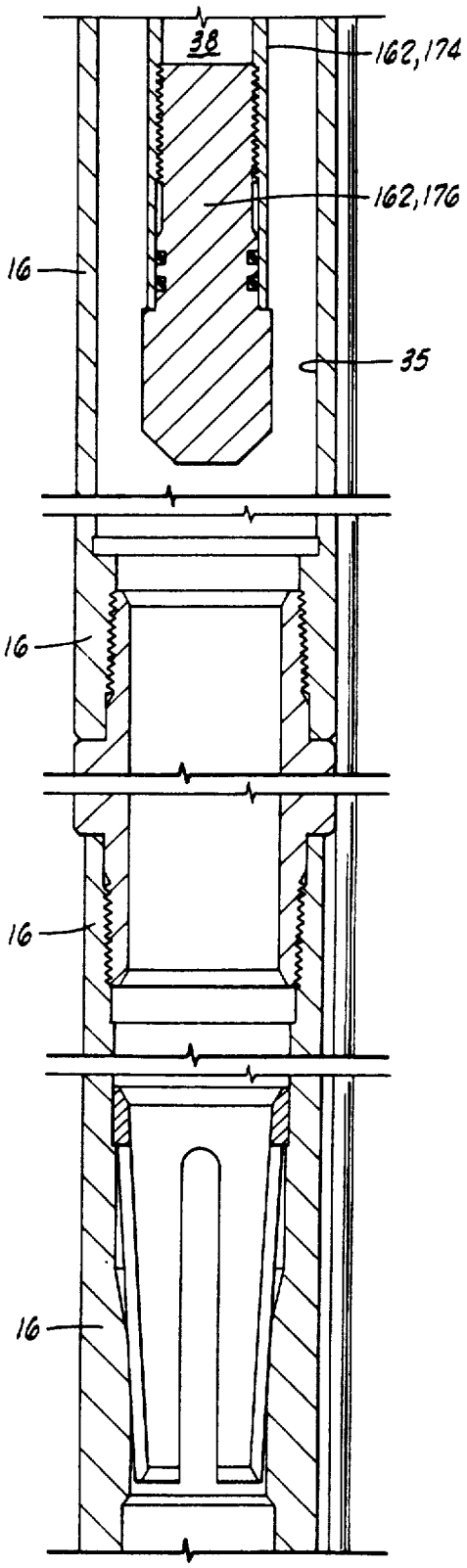
Figure 4E:
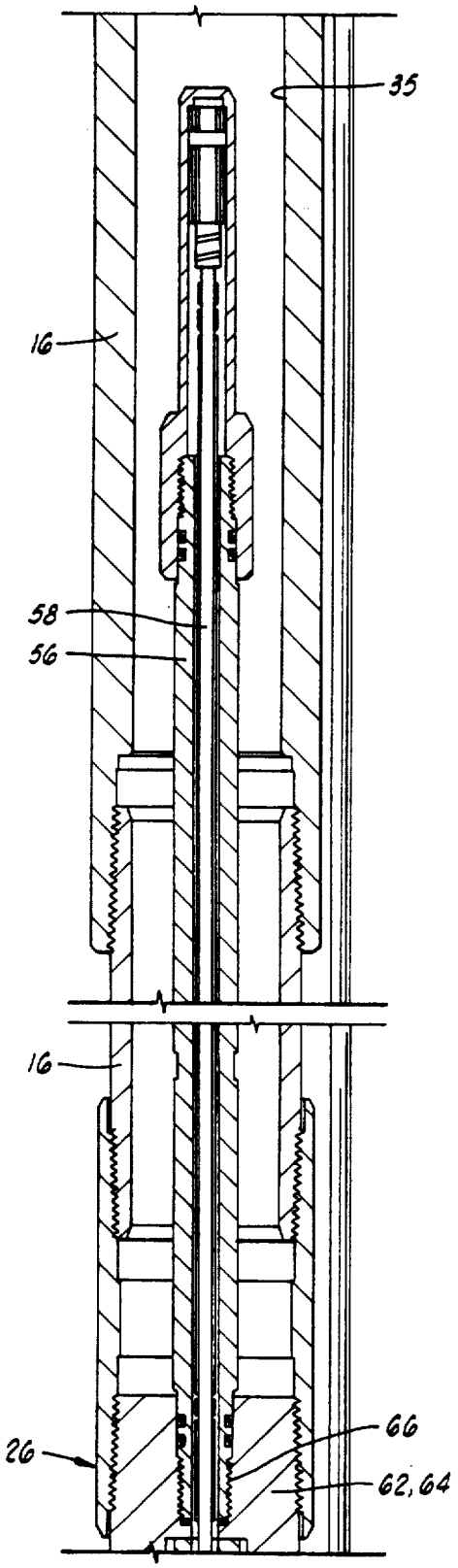
Figure 4F:
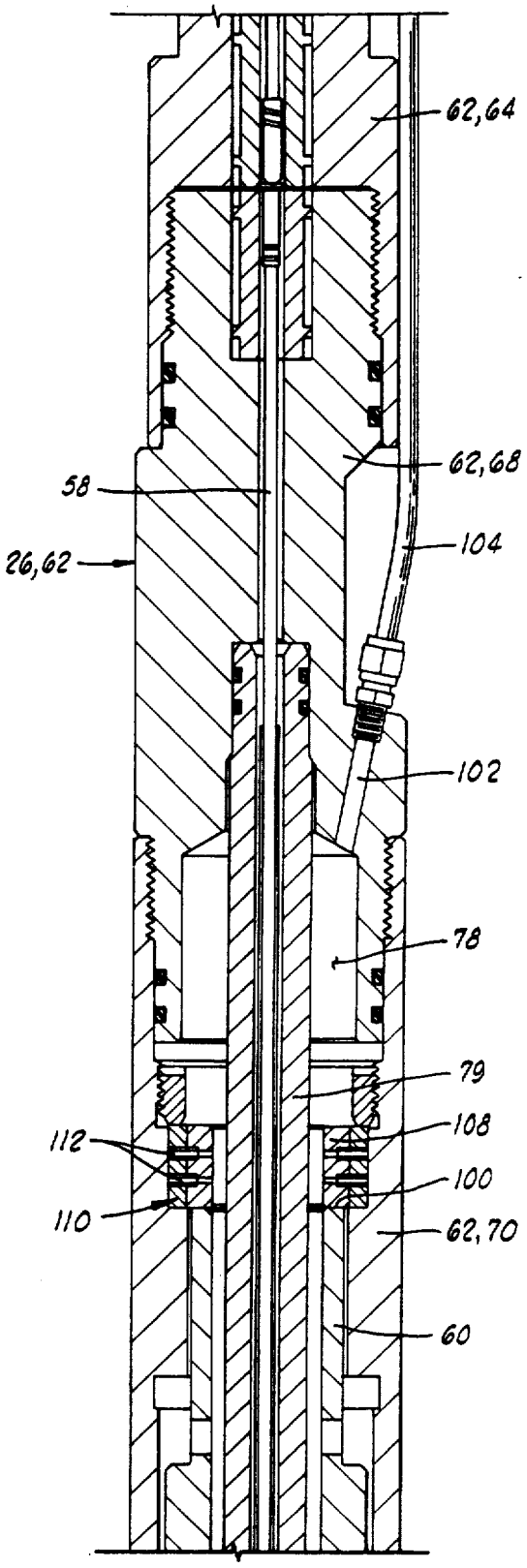
Figure 4G:
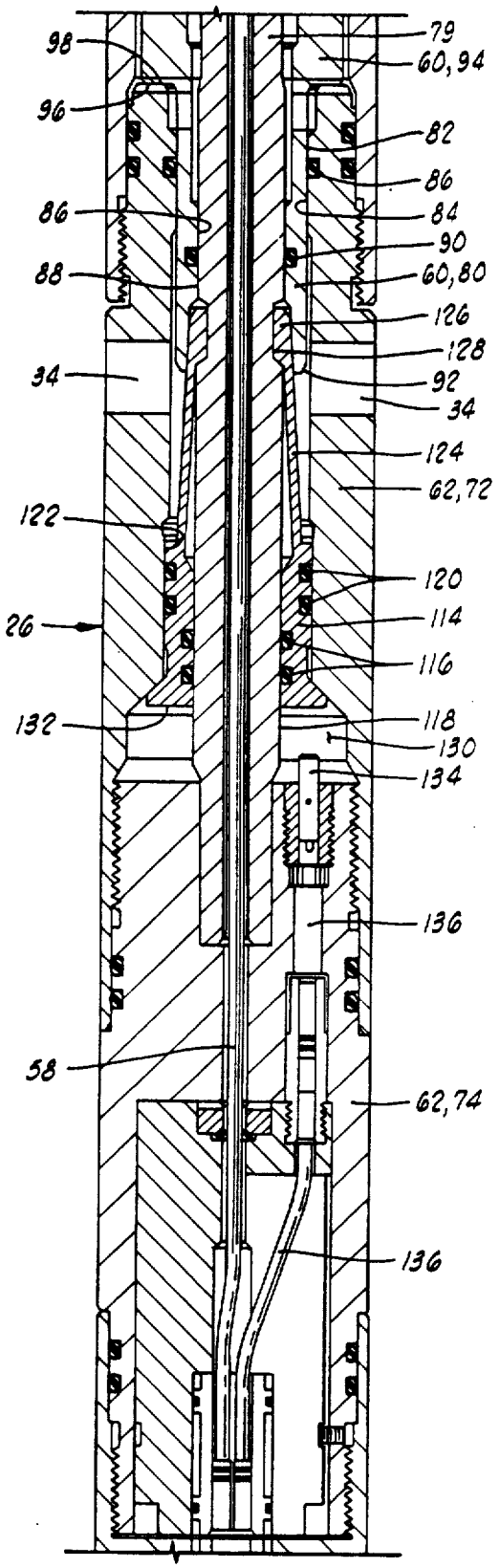

The differential firing head 26 contains an actuating piston 60 (see FIGS. 4F–4G). A high pressure side 92 of the actuating piston 60 is communicated with a well annulus 32 between tubing string 16 and well bore 14 through a high pressure inlet 34. A low pressure side 100 of the actuating piston 60 is communicated with a lower portion 35 of the tubing bore of tubing string 16 below the seating nipple 24.

The seating nipple 24 can be described as dividing the bore of tubing string 16 into an upper tubing bore portion 33 located thereabove and a lower tubing bore portion 35 located therebelow.

The lower tubing bore portion 35 can be generally referred to as a low pressure reference zone 35 communicated with the low pressure side 100 of actuating piston 60. The well annulus 32 can generally be referred to as a high pressure reference zone communicated with the high pressure side 92 of actuating piston 60.

It will be seen that as the tubing string 16 is run into the well as illustrated in FIG. 1, hydrostatic pressure in the well annulus 32 and within the tubing string 16 is balanced through communication ports 23 of perforated nipple 22 and thus is balanced across the actuating piston 60 contained in differential firing head 26.

In FIG. 2, the tubing string 16 has been placed within the well and a firing head actuator generally designated by the numeral 36 has been landed in the seating nipple 24. The firing head actuator includes a low pressure chamber 38 which preferably is an atmospheric chamber filled with air at substantially atmospheric pressure.

The firing head actuator 36 is representative of the embodiment shown in FIGS. 5A–5D of the application. Firing head actuator 36 includes an electric timer means schematically designated as 40. Firing head actuator 36 includes an electromechanical valve 42 which controls communication of the atmospheric chamber 38 with the lower tubing bore 35. A control system schematically illustrated at 44 is responsive to the timer means 40 and controls the valve means 42.

Prior to placement of the firing head actuator 3 in the well 10, the electric timer means 40 is preset so as to allow a predetermined amount of time to pass before the valve 42 is opened. The firing head actuator 36 is then run into the tubing string 16 on a wireline or slick line and is landed in the seating nipple 24 as illustrated in FIG. 2. Then after the timer means 40 times out, the control system means 44 will move the valve 42 from the closed position shown in FIG. 2 to the open position represented in FIG. 3 thus allowing fluid trapped at hydrostatic pressure within the lower tubing bore portion 35 to flow into the atmospheric chamber 38 a represented by arrows 46 thus reducing the pressure on the low pressure side 100 of actuating piston 60 of differential firing head 26. High pressure fluid from well annulus 32 will flow in the high pressure inlet 34 as represented by arrows 48 thus moving the actuating piston 60 of differential firing head 26 and causing differential firing head 26 to fire the perforating gun 28.

The preset electric timer means 40 allows the well 10 to be placed in an underbalanced condition prior to running the firing head actuator 36 into the well, because the firing head actuator can be operated in response to electric timer means 40 without the need to apply increased pressure to the tubing string 16.

The Embodiment of FIGS. 4A–4H

Turning now to FIGS. 4A–4H, a detailed description of one embodiment of the invention is provided. The embodiment illustrated in FIGS. 4A–4H differs somewhat from that schematically illustrated in FIGS. 1–3. The primary difference is that the differential firing head shown in FIGS. 4A–4D utilizes a pressure actuated pyrotechnic time delay device to open the atmospheric pressure chamber, instead of using an electric timer.

Figure 4H:
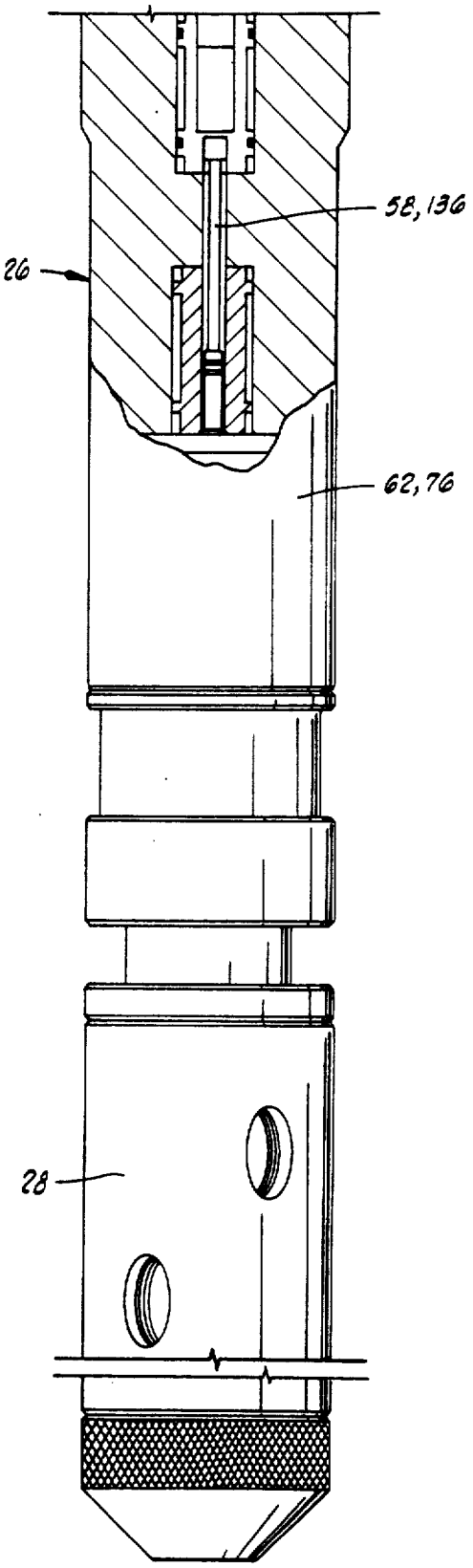

In FIGS. 4A–4H, a portion of the tubing string 16 is shown including the landing nipple 24 (see FIG. 4A), the differential pressure firing head 26 (see FIGS. 4E–4H), and the perforating gun (see FIG. 4H). In the embodiment illustrated in FIGS. 4A–4H, the auto release gun hanger 20 has not been utilized.

The seating nipple 24 preferably is an Otis R Nipple available from the Otis Engineering division of Halliburton Company, the assignee of the present invention, such as shown at page 94 of the Otis Products and Services Catalog OEC 5516 (1989). The seating nipple 24 has a seal bore 50 defined therein and has internal recesses 52 and 54 in which a latching device may be received. The seal bore 50 may also be referred to as a seat 50.

The differential firing head 26 which is seen in FIGS. 4E–4F actually includes two independent firing mechanisms, either one of which may be considered a primary firing mechanism with the other being a backup firing mechanism.

As seen in FIG. 4E, a stinger 56 extends upward from firing head 26 within the lower tubing bore portion 35. Stinger 56 is preferably a stinger of a VannJet firing head available from the Vann Systems division of Halliburton Company, the assignee of the present invention, as illustrated at page TCP-1018 and 1019 of the Vann Systems Engineered Well Completion Product Catalog. The VannJet stinger 56 is of a type well known in the art and it will not be described in detail herein. It is utilized with a VannJet firing head (not shown) which is lowered into the tubing string on a wireline (not shown) and received over the stinger 56 to initiate burning of a first pyrotechnic pathway 58 in response to a pressure increase within the tubing string 16 applied to the VannJet firing head. The pyrotechnic pathway 58 may include pyrotechnic time delay devices.

The present invention is concerned primarily with the other firing mechanism of firing head 26, namely a differential pressure actuating piston 60 seen in FIGS. 4F–4G.

The differential firing head 26 can be described as having a firing head housing assembly 62 which includes an upper housing adapter 64 to which the stinger 56 is attached at threaded connection 66.

Housing assembly 62 further includes a tubing connector housing 68, a shear pin housing 70, a ported housing 72, a firing pin housing 74 and a lower adapter 76 all of which are connected together by conventional threaded connections with O-ring seals provided at appropriate places as illustrated in the drawings.

An inner housing cavity generally designated as 78 is defined within the housing 62 between an inner mandrel 79 on the inside and tubing connector housing 68, shear pin housing 70, and ported housing 72 on the outside. The annular housing cavity 78 receives the previously mentioned actuating piston 60 and other associated structure as will now be described.

The actuating piston 60 includes a lower portion 80 having an outer cylindrical surface 82 closely received within a bore 84 of ported housing section 72. An O-ring seal 86 is received within an annular groove defined in the bore 84 and provides a sliding seal between bore 84 and the piston 60.

The piston 60 has an inner bore 86 defined therethrough which is closely received about an outer cylindrical surface 88 of inner mandrel 79. An O-ring seal 90 is carried by piston 60 and seals between bore 86 and outer surface 88.

An annular differential pressure area of piston 60 is defined between inner O-ring 90 and outer O-ring 86 as seen in FIG. 4G A lower end 92 of piston 60 below this differential area may be defined as a high pressure side 92 of piston 60, and is communicated with the well annulus 32 through high pressure port 34 defined in ported housing section 72.

Actuating piston 60 has an enlarged diameter intermediate portion 94 which in the initial position of FIG. 4G has a downward facing shoulder 96 abutting an upper end 98 of ported housing section 72.

An upper end 100 of piston 60, which may also be referred to as a low pressure side 100 of piston 60 above seals 86 and 90, is communicated with the upper portion of inner housing cavity 78 and is thereby communicated through a port 102 with an external conduit 104 which is communicated through a port 106 seen in FIG. 4B with the lower tubing bore portion 35. It is noted that the external conduit 104 could be replaced by an internal passage (not shown) communicating annular cavity 78 with lower tubing bore portion 35.

The upper end 100 of actuating piston 60 initially abuts an inner ring 108 of a shear sleeve set generally designated by the numeral 110. A plurality of shear pins such as 112 initially hold the actuating piston 60 against upward movement relative to the outer housing assembly 62. As will be further described below, when a sufficient upward differential pressure is applied across actuating piston 60, the shear pins 112 will shear thus allowing the actuating piston 60 to move upward.

In the initial position of actuating piston 60 as seen in FIG. 4G, a firing piston 114 is associated therewith. Firing piston 114 includes a plurality of inner sealing rings 116 which engage an outer surface 118 of inner mandrel 79, and includes a plurality of outer seals 120 which engage a bore 122 of ported housing section 72. A plurality of collet fingers 124 extend upward from firing piston 114 and have enlarged heads 126 thereon which are initially held by actuating piston 60 in a retracted position wherein the enlarged heads 126 are received within a groove 128 defined in inner mandrel 79.

As will be apparent in viewing FIG. 4G, when the upward pressure differential acting on actuating piston 60 is sufficient to shear pins 112 and move actuating piston 60 upward, the enlarged heads 126 of collet fingers 124 will be released and then hydrostatic pressure entering high pressure port 34 will act downward on firing piston 114 to move it downward. A sealed low pressure cavity 130 communicates with a lower end 132 of firing piston 114.

When the firing piston 114 moves downward, it will strike a firing pin 134 thus initiating burning of various elements comprising a second pyrotechnic pathway 136 which will ultimately result in the firing of perforating gun 26 in a conventional manner. The second pyrotechnic pathway 136 may include pyrotechnic time delay devices.

In FIGS. 4A–4D, the details of a firing head actuator 138 are shown. The firing head actuator 138 seen in FIGS. 4A–4D is an alternative embodiment of the firing head actuator 36 which was generally described in reference to FIGS. 2 and 3. As previously noted, the firing head actuator 138 of FIGS. 4A–4D does not use an electrical timer like described with reference to FIGS. 2 and 3 but instead uses a pyrotechnic time delay device.

After the tubing string 16 is placed within the well as schematically illustrated in FIG. 1, the firing head actuator 138 is lowered down into the tubing string 16 on a wireline or slick line and is landed in the seating nipple 24. FIGS. 4A–4D illustrate the firing head actuator 138 after it has been landed in the seating nipple 24.

Firing head actuator 138 includes a locking mandrel 140 which has a latch mechanism 142 which latches into the grooves 52 and 54 of seating nipple 24. Locking mandrel 140 carries an outer packing or seal 144 which seals within the seal bore or seat 50 of seating nipple 24. Locking mandrel 140 is preferably an Otis Model 10RO or Model 710RO lock mandrel available from the Otis Engineering division of Halliburton Company, the assignee of the present invention, and designed for use with an Otis R landing nipple, as is illustrated for example at page 94 of the Otis Products and Services Catalog OEC 5516 (1989).

The locking mandrel 140 supports the remaining portions of the firing head actuator 138 therebelow suspended from the seating nipple 24. The locking mandrel 140 and various other components of the firing head actuator 138 attached thereto are run into the tubing string 16 by a wireline and a running tool (not shown) which releasably latches into the locking mandrel 140. The running tool may be an Otis 'R' Running Tool such as Model 41R018701 available from the Otis Engineering division of Halliburton Company.

An equalizer valve 145 having an equalizer housing 146 is connected to the lower end of locking mandrel 140 at threaded connection 148. A plurality of equalizing ports 150 extend through equalizer valve housing 146 and communicate the lower tubing bore portion 35 located therebelow through an inner bore 152 of lock mandrel 140 with the upper tubing bore portion 33 located above seal bore 50 of seating nipple or landing nipple 24. As seen in the lower portion of FIG. 4A, a sleeve valve element 154 is slidably received within a bore 156 of equalizer valve housing 146 with upper and lower O-ring seals 158 and 160 provided therebetween. The equalizer valve 145 may be an Otis 20R018701 available from the Otis Engineering division of Halliburton Company.

When the locking mandrel 140 is initially run into the tubing string 16 on the wireline running tool (not shown), the sliding sleeve valve element 154 is located downward relative to equalizer valve housing 146 from the position shown in FIG. 4A, so that the upper seal 158 is located below the isolation ports 150. When the wireline running tool is withdrawn from the locking mandrel 140, it pulls the sleeve valve element 154 upward to the position of FIG. 4A wherein the equalizing ports 150 ar closed thus isolating the lower tubing bore portion 35 from the upper tubing bore portion 33 and thus from the well annulus 32 so that any changes in hydrostatic pressure within the well 10 are no longer balanced across the actuating piston 60.

The firing head actuator 138 can be described as having an actuator housing assembly 162 which includes the equalizer valve housing 146, actuator piston housing 164, shear pin housing 166, housing coupling 168, time delay housing 170, upper atmospheric chamber end wall housing 172, atmospheric chamber housing 174, and lower housing plug 176.

An actuator piston 178 has outer O-rings 180 and 182 which seal within a bore 184 of actuator piston housing 164.

The actuator piston 178 has a lower end 186 which abuts an upper end 188 of an actuator firing piston 190. Actuator firing piston 190 carries an upper O-ring seal 192 and lower seals 193 and 195, all closely received within upper bore 194 of shear pin housing 166. A plurality of shear pins 196 initially hold the actuator firing piston 190 in place relative to shear pin housing 166. Actuator piston 190 carries a firing pin 198 on its lower end.

A percussion type pyrotechnic initiator 200 is located below firing pin 198 as seen in FIG. 4B. Operatively associated with percussion initiator 200 are first and second pyrotechnic time delay devices 202 and 204 each of which takes a predetermined time to burn thus providing a predetermined time delay between striking of initiator 200 by firing pin 198 and the completion of burning of the time delay devices 202 and 204.

A shaped explosive charge 206 is located below second time delay device 204 and operatively associated therewith so that explosive charge 206 is detonated by second time delay device 204 after the predetermined time delay. More than two-time delay devices may be used to provide greater time delays.

The upper atmospheric end wall housing 172 closes the upper end of the low pressure chamber 38 thus sealing the same. An upper end wall 208 of atmospheric chamber 38 is defined by the upper atmospheric chamber end wall housing 172. An open bore 210 is located immediately below shaped charge 206 and leads to the upper end wall 208. A communication bore 212 extends diametrically through the upper end wall 208.

When the shaped charge 206 explodes, an explosive jet will extend downward therefrom through the open bore 210 and will pierce the upper end wall 208 into the atmospheric chamber 38, and intersecting the communication bore 208. Thus, upon firing of the shaped charge 206, the atmospheric chamber 38 will be placed in communication with the lower tubing string bore portion 35 through the communication bore 212.

It will be recalled that well fluid at substantially hydrostatic pressure was previously trapped in the lower tubing string bore portion 35 and against the upper end or low pressure side 100 of actuating piston 60. When the shaped charge 206 fires and pierces the upper end wall 208, the pressure trapped in lower tubing bore portion 35 will be vented into the atmospheric chamber 38 thus substantially immediately reducing the pressure seen by the low pressure side 100 of actuating piston 60 to approximately atmospheric pressure. Since hydrostatic pressure is still seen by the high pressure side 92 of actuating piston 60, a large upwardly acting pressure differential will be immediately present across actuating piston 60 thus providing sufficient force to shear shear pins 112 and to move actuating piston 60 upward. Upward movement of actuating piston 60 releases the firing piston 114 which will then be moved downward by the pressure differential acting across firing piston 114. The downward moving firing piston 114 will strike firing pin 134 thus initiating the pyrotechnic path 136 which will in turn fire the perforating gun 28.

The shaped charge 206 and associated apparatus may be generally described as an operating means 206 for communicating the lower tubing bore portion 3 with the atmospheric chamber 38 so as to drop pressure in the lower tubing bore portion 35 and to actuate the differential firing head 26.

The actuator piston 178, actuator firing piston 190 and percussion initiator 200 may be collectively described as a pressure responsive initiator means for initiating burning of the time delay devices 202 and 204. The time delay devices 202 and 204 may be generally described as a timer means for providing a preset time delay between starting of the timer means with initiator 200 and operation of the shaped charge 206 to communicate the atmospheric chamber 38 with the lower tubing bore 35 and to thereby move the actuating piston 60 and fire the perforating gun 28.

The Embodiment of FIGS. 5A-5D

FIGS. 5A-5D comprise an elevation sectioned view of the firing head actuator 38 with an electric timer means 40 as was schematically shown in FIGS. 2 and 3. The tubing string 16 and various components thereof previously described are the same in the embodiment of FIGS. 5A-5D and thus like numerals are used to identify those parts as were used in FIGS. 4A-4H.

The firing head actuator 36 includes a locking mandrel 140 and the equalizer valve 145 just as was utilized with the firing head actuator 138 of FIGS. 4A-4H.

The firing head actuator 36 includes an actuator housing assembly 214 which includes the equalizer valve housing 146, a housing adapter 216, an electronics housing 218, a motor housing 220, a housing adapter 222, a valve housing 224, an air chamber adapter 226, an air chamber housing 228, and lower end plug 230.

A battery pack 232 and an electronics package 234 are located in electronics housing 218 and are connected by power cable 236 to an electric motor 240 The electronics package 234 includes timer means 40. An elastomeric shock absorber ball 231 is located between the upper end of battery 232 and a plug 229 received in housing adapter 216. The timer means 40 includes circuitry which can be set to provide a predetermined elapsed time in the range of from one hour to seven days which will run after the timer 40 is set and before the motor 240 begins to operate. The motor 240 is part of the operating means 44 in FIGS. 2 and 3.

After the time determined by timer 40 has elapsed, the motor 240 rotates a lead screw 242 which is held longitudinally in place between bearings 244 and 246. Lead screw 242 drives a threaded collar 248 upward relative to the housing assembly 214. A lug 249 extends from collar 248 into slot 251 of housing adapter 222 to prevent rotation of collar 248. The threaded collar 248 has an elongated slot 250 defined therein within which is received a lug 252 attached to a valve stem 254. Valve stem 254 has a valve member 256 defined on a lower end thereof. Valve member 256 is initially closely received within a bore 258 of air chamber adapter 226 with a pair of O-ring seals 260 sealing therebetween.

Figure 5A:
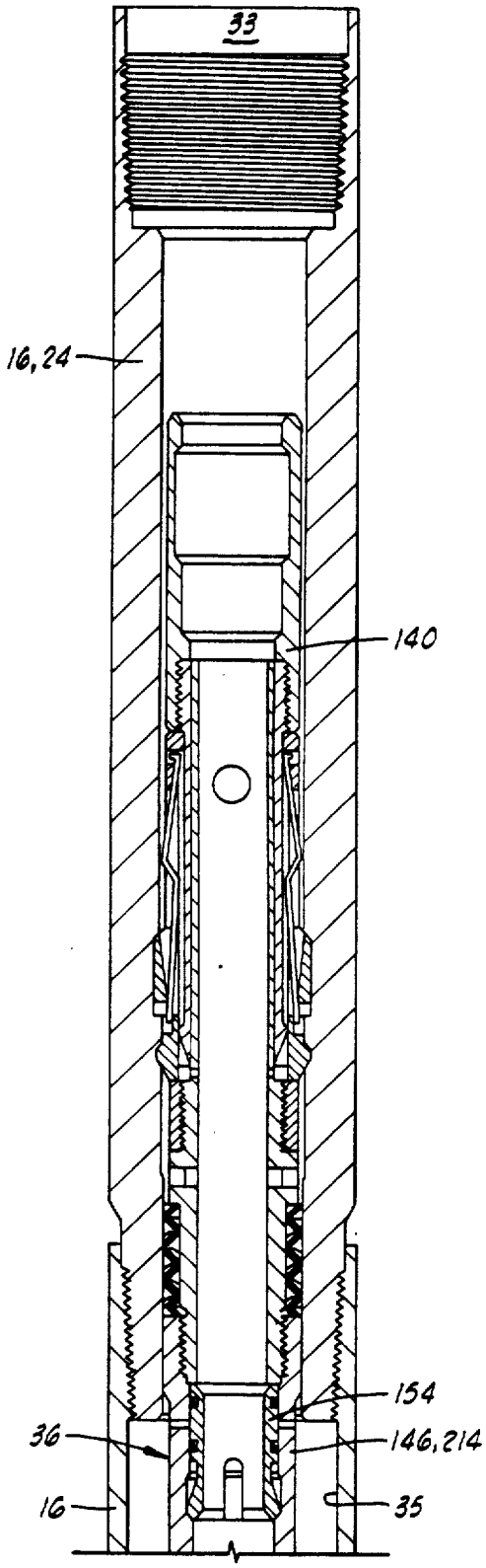
FIG. 5A-5D comprise an elevation sectioned view of the upper portions of a second embodiment of the invention utilizing an electric self-contained timer for operating th atmospheric pressure chamber actuator.
Figure 5B:
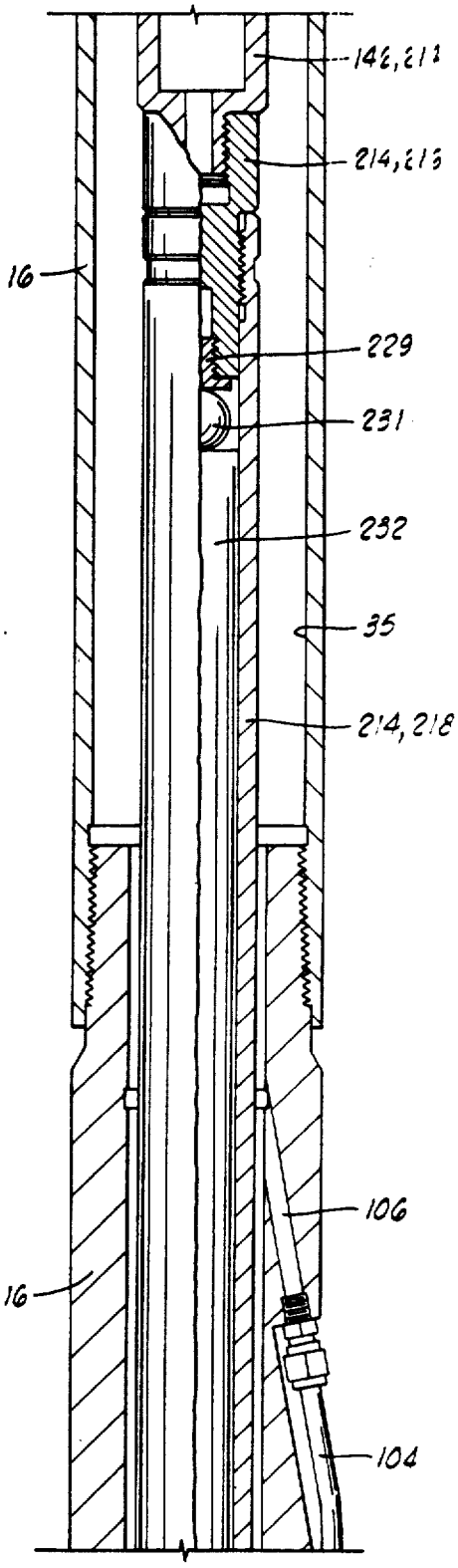
Figure 5C:
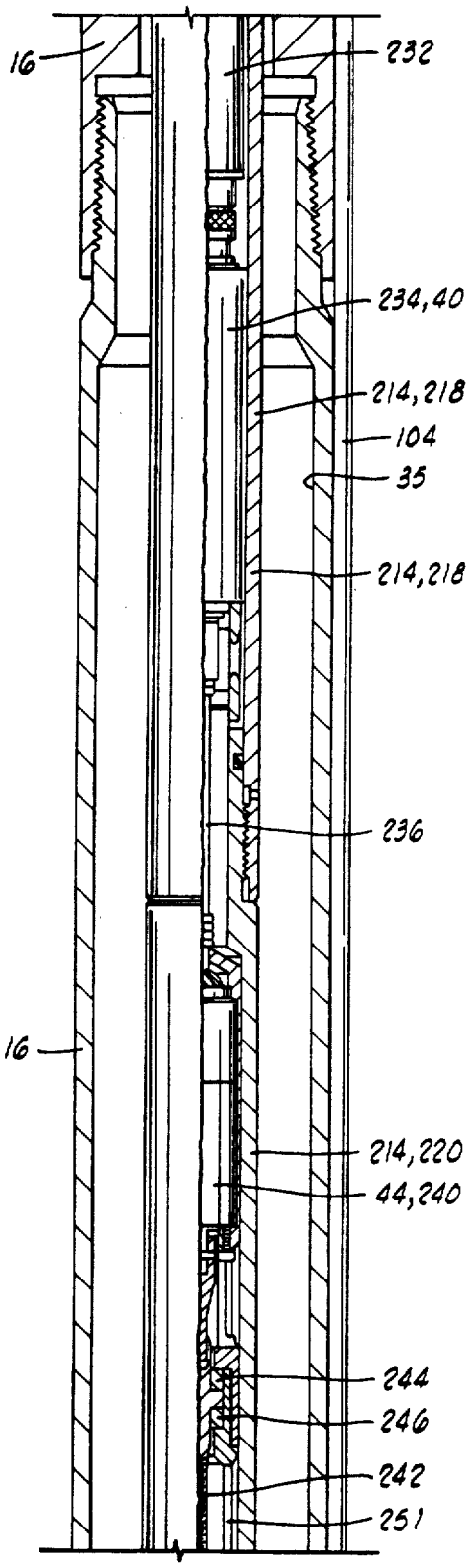
Figure 5D:
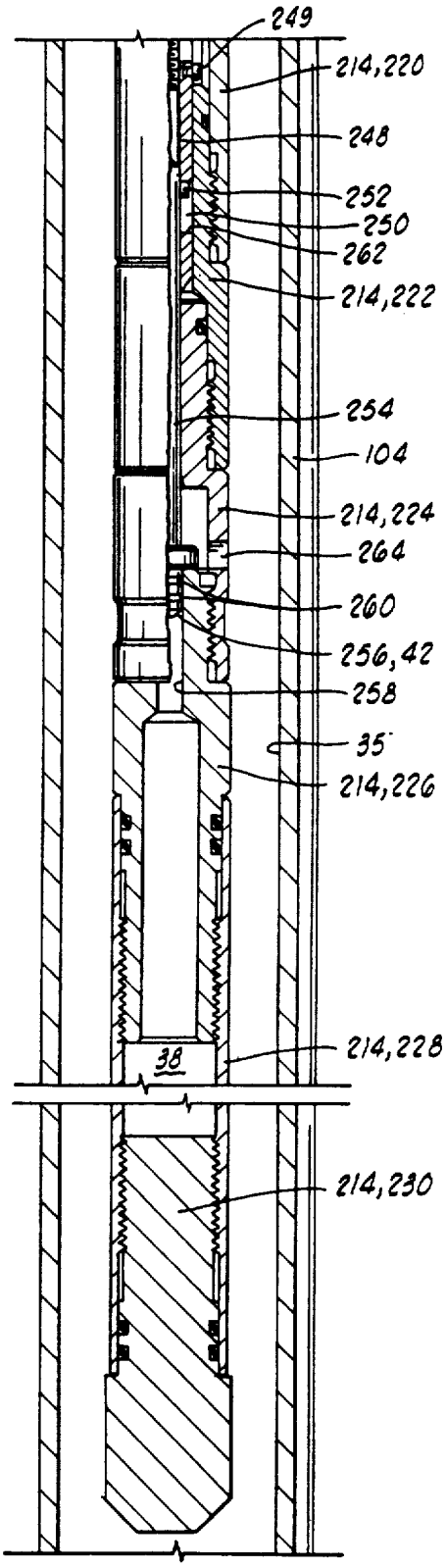

As will be apparent in FIG. 5D, when the valve member 256 is in its lowermost position as illustrated in FIG. 5D, the O-ring seals 260 and valve member 256 block the bore 258 thus closing the atmospheric chamber 38.

After the electronic timer 40 determines that the preset time delay has elapsed, it will cause the electric motor 240 to rotate the lead screw 242 thus pulling collar 248 upward. The collar 248 will move upward until a lower end 262 of slot 250 engages lug 252 and then pulls valve stem 254 upward thus pulling the O-ring seals 260 out of engagement with bore 258 thus permitting the atmospheric chamber 38 to be communicated with the lower tubing bore portion 35 through a port 264 defined in valve housing 224. This in turn causes actuating piston 60 to release firing piston 114 to fire perforating gun 28.

The electronic timer means 40 can be constructed in a manner similar to that disclosed in U.S. patent application Ser. No. 07/868,832 of Schultz et al., entitled SHUT-IN TOOLS filed Apr. 14, 1992, the details of which are incorporated herein by reference.

It will be appreciated that with the firing head 36 of FIGS. 5A-5D, it is necessary to start the electric timer means 40 running before the firing head actuator 36 is run into the tubing string 16 on the wireline (not shown). Thus, the timer means 40 will be preset for a sufficient time to allow the firing head actuator 36 to be run into the tubing string 16, and landed in the landing nipple 24 prior to the time the timer means 40 times out and initiates the actuating sequence which fires perforating gun 28.

Alternatively, it is noted that the firing head actuator 36 utilizing the electronic timer 40 could be modified by equipping it with a rupture disc which would be sheared due to pressure encountered at a predetermined depth and thus the electronic timer could in fact be started downhole in response to an increase in pressure. If that modification is made, however, the only advantage of the electronic timer system over the pyrotechnic time delay provided by firing head actuator 138 is that much longer time delay intervals may be programmed with the electronic timer.

SUMMARY OF OPERATION

The operation of the systems shown in FIGS. 1-5 can be generally summarized as follows.

The systems provide methods of perforating the well 10 which include a first step of assembling on the tubing string 16 the perforating gun 28 and the differential pressure firing head 26 including the actuating piston 60 having the high pressure side 92 and the low pressure side 100.

Then the tubing string 16 is run into the well 10 to a location wherein the perforating gun 28 is adjacent a subsurface zone which is to be perforated.

Next, all surface equipment is installed and pressure testing is completed. Hydrostatic pressure in the well is then adjusted by swabbing, gas lift or other procedure to create the desired underbalance in the well.

Then, the selected firing head actuator 36 or 138 is run into the tubing string 16 on a slick line (not shown) and landed in the landing nipple 24. The firing head actuator 36 or 138 includes a low pressure chamber 38.

As the tubing string 16 is run into the well, hydrostatic pressure in the well and in tubing string 16 is balanced across the actuating piston 60 since communication is provided through the perforated nipple 22. When the firing head actuator is landed in the landing nipple 24, the slick line and running tool are withdrawn and the equalizer valve 145 is closed. When equalizer valve 145 closes, the firing head actuator isolates the lower tubing bore portion 35 from the well annulus 32 thereby trapping hydrostatic pressure in the lower tubing bore portion 35.

Subsequently, the lower pressure chamber 38 is communicated with the low pressure side of actuating piston 60 either by opening of valve element 256 for the firing head actuator 36 or firing of the shaped charge 206 to perforate wall 208 for the firing head actuator 138. This creates an upwardly acting pressure differential across the actuating piston 60.

The actuating piston 60 will then move upward in response to this differential pressure which will in turn release the firing piston 114 which will move downward striking firing pin 134 and initiating the pyrotechnic path 136 which will fire the perforating gun 28.

If the pyrotechnically actuated firing head actuator 138 of FIGS. 4A-4D is utilized, the well may be placed in an underbalanced position prior to landing the firing head actuator 138, but the tubing string 16 itself will have an increased pressure applied thereto in order to force the actuator piston 178 downward. The time delay provided by pyrotechnic time delay devices 202 and 204, however, provide sufficient time for that increased pressure to be bled off before the perforating gun 28 is fired. The time delay provided by pyrotechnic devices 202 and 204 may for example be on the order of six to twenty-four minutes.

If the firing head actuator 36 of FIGS. 5A-5D is utilized, there is never any need for applying pressure to the tubing string 16 to fire the guns 28, so this embodiment is particularly adaptable to underbalanced perforating. The electric timer means 40 is set and started before firing head actuator 36 is run into the tubing string, and when the set time expires the perforating gun 28 will be fired.

The provision of dual firing head 26 having two alterative means for firing of the perforating gun 28 provides increased reliability of the system. As will be appreciated by those skilled in the art, sometimes a firing system like that utilizing the VannJet stinger 58 shown in FIG. 4E can encounter difficulties in operation due to the collection of debris within the tubing bore which may prevent the VannJet stinger 58 from being properly received within the VannJet firing system (not shown) which is normally lowered on wireline or slick line into engagement therewith to fire the same. If that occurs, the perforating gun 28 can then be fired through use of firing head actuator 36 or 138 which can be lowered into engagement with the landing nipple 24. The landing nipple 24 may for example be placed a substantial distance above the firing head 26, i.e., on the order of sixty feet, so as to provide plenty of room therebelow to receive any expected amount of debris so that there will never be enough debris received in the tubing string so a to block the tubing bore all the way up to the landing nipple 24.

Through the use of a pressure balanced firing head, various pressure operations such as displacing fluids, pipe and packer testing and the like can be conducted without fear of prematurely firing the perforating gun 28 since the firing head actuator 36 or 138 will not be run into the tubing string 16 until those other pressure operations have been performed.

The choice of the pyrotechnically operated firing head actuator 138 or the electronic firing head actuator 36 will be based on well conditions and parameters including but not limited to the formation pressure, bottom hole temperature, bottom hole pressure and the desired underbalance.

For example, the firing head actuator 36 including an electronic timer will lend itself well to completions where partially dry tubing is required to achieve the desired underbalance. In these applications, the tubing string 16 will be displaced with nitrogen, swabbed or gas lifted to the desired level. The electronic timer will be started at the surface and programmed for the desired time delay. It is important to note that no explosives are associated with the firing head actuator 36 having the electronic timer and thus it is safe to arm at the surface before it is placed in the well. Furthermore, by initiating the electronic timer at the surface, the need to apply any pressure to start the timer is eliminated. One advantage of this system over prior art devices is that the underbalance can be established and the well subsequently perforated without applying any additional pressure down the tubing or casing. This feature can be most appreciated when applied to low reservoir pressures which typically require gas lifting or a low fluid level in the tubing to achieve the desired underbalance.

The firing head actuator 138 of FIGS. 4A-4D utilizing pyrotechnic time delay devices may be preferable when the bottom hole temperature exceeds the operating limitations of the electronic timer 40 or when the fluid level in the well is at or near the surface. The time delay provided by the pyrotechnic time delay devices will be determined per the well requirements and required bleed-off time, but generally will be in the range of from six to twenty-four minutes in duration.

Thus it is seen that the apparatus and methods of the present invention readily achieve the ends and advantages mentioned as well as those inherent therein. While certain preferred embodiments of the invention have been illustrated and described for purposes of the present disclosure, numerous changes may be made by those skilled in the art which changes are encompassed with the scope and spirit of the present invention as defined by the appended claims.

What is claimed is:

1. A method of perforating a well, comprising:

(a) assembling on a tubing string, a perforating gun and a differential pressure firing head, said differential pressure firing head including an actuating piston having a high pressure side and a low pressure side;

(b) running said tubing string into said well;

(c) running a firing head actuator into said tubing string and landing said firing head actuator in said tubing string, said firing head actuator including a low pressure (d) communicating said low pressure chamber with said low pressure side of said actuating piston and thereby creating a pressure differential across said actuating piston;

(e) moving said actuating piston in response to said pressure differential; and (f) firing said perforating gun in response to moving said actuating piston.

2. The method of claim 1, further comprising:

during step (b), balancing hydrostatic pressure in said well across said actuating piston as said tubing string is run into said well.

3. The method of claim 2, further comprising:

communicating said high pressure side of said actuating piston with a well bore of said well;

communicating said low pressure side of said actuating piston with a tubing bore of said tubing string; and during step (b), communicating said well bore and said tubing bore.

4. The method of claim 1, wherein:

in step (a), said low pressure side of said actuating piston is communicated with a portion of a tubing bore of said tubing string; and in step (c), said firing head actuator isolates said portion of said tubing bore from said well bore thereby trapping hydrostatic pressure in said isolated portion of said tubing bore communicated with said low pressure side of said actuating piston.

5. The method of claim 4, wherein:

step (d) includes communicating said low pressure chamber with said isolated portion of said tubing bore and thus with said low pressure side of said actuating piston.

6. The method of claim 4, wherein:

step (c) includes landing said firing head actuator in a landing nipple located in said tubing string above said differential pressure firing head.

7. The method of claim 1, wherein:

in step (c), said low pressure chamber contains air at substantially atmospheric pressure.

8. The method of claim 1, further comprising:

prior to step (c), creating an underbalanced condition in said well adjacent said perforating gun by reducing the hydrostatic pressure in said tubing string and in said well below that which existed during step (b), and communicating said underbalanced condition through said tubing string to said low pressure side of said actuating piston.

9. The method of claim 1, wherein:

in step (c), said firing head actuator includes an electromechanically actuated valve which isolates said low pressure chamber from said low pressure side of said actuating piston and includes a variable electric timer which controls said valve; and said method further includes:

prior to placing said firing head actuator in said tubing string, presetting a time delay of said variable electric timer; and step (d) is performed in response to said preset time delay timing out.

10. The method of claim 9, further comprising:

prior to placing said firing head actuator in said tubing string, starting said variable electric timer running.

11. The method of claim 9, further comprising:

starting said electric timer running, after said firing head actuator is placed in said tubing string, in response to a pressure encountered by said firing head actuator.

12. The method of claim 1, wherein:

in step (c), said firing head actuator includes a pressure actuated pyrotechnic time delay device;

said method further includes between steps (c) and (d):

increasing pressure in said tubing string above hydrostatic pressure to initiate said pressure actuated pyrotechnic time delay device; and reducing pressure in said tubing string back toward hydrostatic pressure before said pyrotechnic time delay device has finished burning; and step (d) includes firing an explosive charge with said pyrotechnic time delay device to communicate said low pressure chamber with said low pressure side of said actuating piston.

13. A method of perforating a well, comprising:

(a) assembling on a tubing string, a perforating gun and a differential pressure firing head, said differential pressure firing head including an actuating piston having a high pressure side communicated with an exterior of said tubing string and a low pressure side communicated with a tubing bore of said tubing string;

(b) running said tubing string into said well;

(c) balancing hydrostatic pressure across said actuating piston as said tubing string is run into said well and until step (d);

(d) landing a firing head actuator in said tubing string above said differential pressure firing head and isolating a portion of said tubing bore from said well, said isolated portion of said tubing bore being communicated with said low pressure side of said actuating piston, said firing head actuator including a sealed low pressure chamber;

(e) opening said sealed low pressure chamber to said isolated portion of said tubing bore and thereby reducing the pressure in said isolated portion of said tubing bore which is communicated with said low pressure side of said actuating piston and thereby creating a pressure differential across said actuating piston;

(f) moving said actuating piston in response to said pressure differential; and (g) firing said perforating gun in response to moving said actuating piston.

14. A well perforating system, comprising:

a tubing string disposed in a well bore, said tubing string having a tubing bore;

a perforating gun connected to said tubing string;

a differential pressure firing head connected to said tubing string, said firing head including an actuating piston having a high pressure side communicated with a high pressure reference zone and said actuating piston having a low pressure side communicated with a portion of said tubing bore defining a low pressure reference zone, said firing head being operably associated with said perforating gun so that said perforating gun is fired in response to movement of said actuating piston;

a seat defined within said tubing string above said firing head;

a communication port defined in said tubing string above said seat and communicating said low pressure reference zone of said tubing bore with said high pressure reference zone so that hydrostatic pressure within said low pressure reference zone and said high pressure reference zone and thus pressure across said actuating piston is balanced so long as said low pressure reference zone of said tubing bore is open to said communication port; and a firing head actuator adapted to be landed in said seat to close said tubing bore at said seat and to isolate said low pressure reference zone of said tubing bore from said high pressure reference zone, said firing head actuator including a low pressure chamber and operating means for communicating said low pressure reference zone of said tubing bore with said low pressure chamber to drop pressure in said low pressure reference zone and tubing bore.

15. The system of claim 14, wherein:

said high pressure reference zone is said well bore.

16. The system of claim 14, wherein:

said low pressure chamber is an atmospheric chamber.

17. The system of claim 14, wherein:

said operating means of said firing head actuator includes a timer means for providing a preset time delay between starting of said timer means and communication of said low pressure chamber with said low pressure reference zone.

18. The system of claim 17, wherein:

said timer means is a variable electric timer means which is so arranged and constructed that it can be preset and started before said firing head actuator is run into said tubing string.

19. The system of claim 17, wherein:

said operating means of said firing head actuator includes an electromechanical valve controlling communication between said low pressure chamber and said low pressure reference zone of said tubing bore, and a control system means responsive to said timer means for opening said valve when said timer means times out.

20. The system of claim 17, wherein: device and a pressure responsive initiator means for initiating burning of said pyrotechnic time delay device.

21. The system of claim 20, wherein:

said operating means of said firing head actuator includes an explosive charge arranged to be fired in response to said pyrotechnic time delay device and to explosively perforate a wall separating said low pressure chamber from said low pressure reference zone of said tubing bore.

22. The system of claim 14, wherein:

said firing head actuator includes an equalizing valve means which is arranged and constructed so as to be open as said firing head actuator is run into said well bore and landed in said seat, and so as to be closed after said firing head actuator is landed in said seat for thereby isolating said low pressure reference zone from said high pressure reference zone.

23. The system of claim 14, wherein:

said differential pressure firing head is a dual firing head including a backup firing system extending upward into said low pressure reference zone of said tubing bore.

24. A well perforating system, comprising:

a tubing string disposed in a well bore;

a perforating gun included in said tubing string;

a differential pressure firing head included in said tubing string, said firing head including an actuating piston having a high pressure side and a low pressure side, said firing head being operably associated with said perforating gun so that said perforating gun is fired in response to movement of said actuating piston; and a firing head actuator adapted to be landed in said tubing string, said firing head actuator including a low pressure chamber and operating means for communicating said low pressure chamber with said low pressure side of said actuating piston.

25. The system of claim 24, wherein:

said operating means includes a timer means for providing a time delay prior to communication of said low pressure chamber with said low pressure side of said actuating piston.

26. The system of claim 25, wherein:

said timer means is a variable time delay electric timer means.

27. The system of claim 25, wherein:

said timer means includes a pyrotechnic time delay device.

28. A firing head actuator apparatus for actuating a differential pressure firing head of a perforating gun conveyed into a well bore on a tubing string, comprising:

an actuator housing adapted to be landed in said tubing string;

a sealed low pressure chamber defined within said actuator housing;

communication means for selectively communicating said sealed low pressure chamber with said differential pressure firing head when said communication means is actuated;

timer means, disposed in said actuator housing, for providing a time delay between starting of said timer means and actuation of said communication means; and control means, responsive to said timer means, for actuating said communication means to communicate said low pressure chamber with said differential pressure firing head and for thereby actuating said differential pressure firing head and firing said perforating gun in response to timing out of said timer means.

* * * * *